US009593880B2

(12) United States Patent
Choo et al.

(10) Patent No.: US 9,593,880 B2
(45) Date of Patent: Mar. 14, 2017

(54) REFRIGERATOR

(71) Applicant: LG ELECTRONICS INC., Seoul (KR)

(72) Inventors: Ayoung Choo, Seoul (KR); Jaeyoul Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/948,886

(22) Filed: Nov. 23, 2015

(65) Prior Publication Data

US 2016/0146532 A1 May 26, 2016

(30) Foreign Application Priority Data

Nov. 24, 2014 (KR) ..... 10-2014-0164533

(51) Int. Cl.
*F25D 25/02* (2006.01)
*A47B 88/04* (2006.01)
(Continued)

(52) U.S. Cl.
CPC ..... *F25D 25/024* (2013.01); *A47B 88/047* (2013.01); *A47B 88/12* (2013.01); *A47B 88/16* (2013.01); *A47B 57/06* (2013.01); *A47B 96/025* (2013.01); *F25D 23/067* (2013.01); *F25D 25/04* (2013.01); *F25D 2325/021* (2013.01)

(58) Field of Classification Search
CPC ..... F25D 23/067; F25D 25/024; F25D 25/02; A47B 88/047; A47B 88/12; A47B 88/16
USPC .... 312/401, 408, 410, 208.1, 248, 311, 321; 211/90.02, 90.03; 62/382; 108/31, 96, 108/106, 138, 145, 149
See application file for complete search history.

(56) References Cited

U.S. PATENT DOCUMENTS 1,147,998 A * 7/1915 Anderson ..... A47B 17/04 312/204
2,284,339 A * 5/1942 Nauert ..... F25D 25/02 211/134
(Continued)

FOREIGN PATENT DOCUMENTS

CN 202562193 11/2012
JP H07-035469 2/1995
(Continued)

OTHER PUBLICATIONS

Extended European Search Report issued in European Application No. 15190410.9 on Mar. 30, 2016, 7 pages.

*Primary Examiner* — James O Hansen
(74) *Attorney, Agent, or Firm* — Fish & Richardson P.C.

(57) ABSTRACT

A refrigerator includes a first guide hole located at a first inner wall of a storage compartment, a second guide hole located at a second inner wall of the storage compartment, a first rotating bar that includes a first rotating shaft fitted in the first guide hole, and a second rotating bar that includes a second rotating shaft fitted in the second guide hole. A shelf is rotatably supported by the first rotating bar and the second rotating bar and is adjustable in height based on rotation of the first rotating bar and the second rotating bar. Also, the first guide hole has a first space that extends in a forward and rearward direction and that allows the first rotating shaft to slide and the second guide hole has a second space that extends in the forward and rearward direction and that allows the second rotating shaft to slide.

20 Claims, 8 Drawing Sheets

(51) Int. Cl.

| | |
|---|---|
| ***A47B 88/12*** | (2006.01) |
| ***A47B 88/16*** | (2006.01) |
| *F25D 23/06* | (2006.01) |
| *F25D 25/04* | (2006.01) |
| *A47B 57/06* | (2006.01) |
| *A47B 96/02* | (2006.01) |

(56) References Cited

U.S. PATENT DOCUMENTS 2,599,416 A * 6/1952 Saecker ..... A47B 23/04 248/447
2,822,229 A * 2/1958 Carlson ..... A47B 77/12 248/586
2,855,262 A * 10/1958 Sharpe ..... F25D 25/021 312/319.3
3,857,623 A * 12/1974 Schneller ..... A47B 46/005 312/266
4,098,094 A * 7/1978 Linstromberg ..... F25C 5/005 312/311
4,528,825 A * 7/1985 Khan ..... A47B 77/10 312/313
7,618,103 B2 * 11/2009 Kim ..... A47B 46/00 108/138
2002/0109444 A1 * 8/2002 Webb ..... A47B 96/025 312/313
2004/0195945 A1 * 10/2004 Farber ..... A47B 57/04 312/408
2004/0207305 A1 * 10/2004 Kim ..... F25D 25/027 312/408
2006/0125362 A1 6/2006 Kim

FOREIGN PATENT DOCUMENTS

| | | |
|---|---|---|
| JP | 2005-230468 | 9/2005 |
| KR | 20-1998-0018116 | 7/1998 |
| KR | 20-0155035 | 8/1999 |
| KR | 10-2004-0039748 | 5/2004 |
| KR | 10-0582073 | 5/2006 |

* cited by examiner

FIG. 4(a)
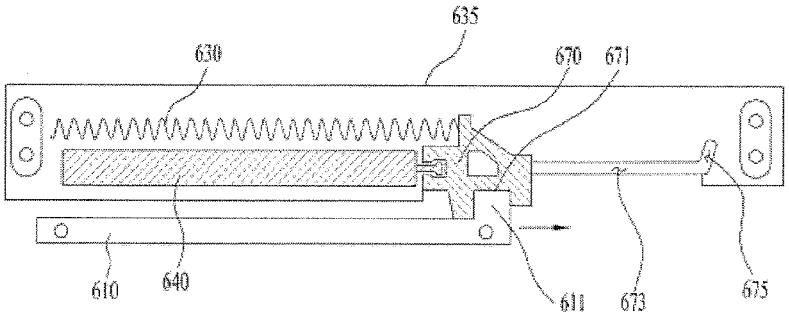
FIG. 4(b)
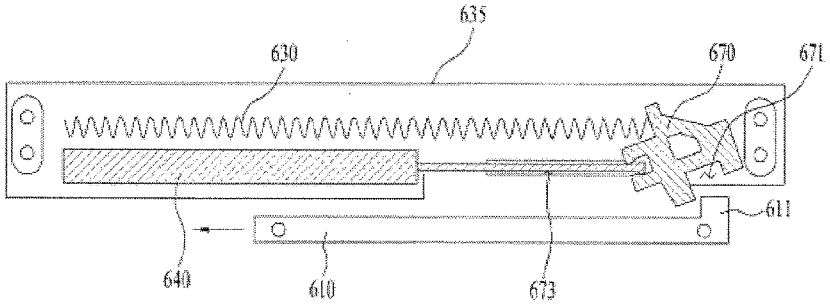

REFRIGERATOR

This application claims the benefit of Korean Patent Application No. 10-2014-0164533, filed on Nov. 24, 2014, which is hereby incorporated by reference as if fully set forth herein.

FIELD

The present disclosure relates to a refrigerator including, for example, a refrigerator equipped with a shelf capable of being moved vertically and in the forward and rearward direction.

BACKGROUND

Generally, a refrigerator is an apparatus for freezing or refrigerating objects stored therein by lowering a temperature inside a storage compartment using cold air generated by a refrigerating system.

A refrigerator employs a refrigerating system in order to create cold air to be supplied to its storage compartment. The refrigerating cycle undergoes a compression process, a condensation process, an expansion process and an evaporation process, and returns to the compression process in a cyclical fashion. Cold air created through the evaporation process is supplied to the inside of the storage compartment to lower the temperature of objects stored in the storage compartment.

A refrigerator also may be provided with a freezing compartment which is configured to keep the temperature inside the compartment below the freezing point in order to store objects in a frozen state and a refrigerating compartment which is configured to keep the temperature inside the compartment below the ambient temperature in order to store objects at a refrigerated temperature.

The freezing compartment and the refrigerating compartment each may be provided with a plurality of shelves for dividing the compartment vertically so as to accommodate objects having various sizes and to efficiently manage the compartment. The shelves may be detachably secured to the inner wall of the compartment so that they are able to be installed at different heights.

A refrigerator may include a plurality of support ribs formed on both lateral inner surfaces of the storage compartment such that shelves are slidably fitted on the ribs. Alternatively, a shelf may be installed in the storage compartment of a refrigerator in such a way that mounting rails, each of which has a plurality of holes formed at different heights, are attached to the inner wall of the storage compartment, and a pair of cantilevers provided on a shelf are fitted in the respective holes.

SUMMARY

In one aspect, a refrigerator includes a cabinet that defines an appearance of the refrigerator and a storage compartment defined in the cabinet and configured to store an object. The refrigerator also includes a first guide hole located at a first inner wall of the storage compartment and a second guide hole located at a second inner wall of the storage compartment. The second inner wall of the storage compartment is opposite of the first inner wall of the storage compartment. The refrigerator further includes a first rotating bar that includes a first rotating shaft fitted in the first guide hole, a second rotating bar that includes a second rotating shaft fitted in the second guide hole, and a shelf configured to support an object stored in the storage compartment. The first rotating bar is configured to rotate about the first rotating shaft, the second rotating bar is configured to rotate about the second rotating shaft, and the shelf is rotatably supported by the first rotating bar and the second rotating bar and is adjustable in height based on rotation of the first rotating bar and the second rotating bar. The first guide hole has a first space that extends in a forward and rearward direction and that allows the first rotating shaft of the first rotating bar to slide in the first guide hole in the forward and rearward direction. The second guide hole has a second space that extends in the forward and rearward direction and that allows the second rotating shaft of the second rotating bar to slide in the second guide hole in the forward and rearward direction. The shelf is configured to slide in the forward and rearward direction based on the first rotating shaft of the first rotating bar sliding in the first guide hole with the second rotating shaft of the second rotating bar sliding in the second guide hole.

Implementations may include one or more of the following features. For example, the refrigerator may include a first elastic element disposed in the first guide hole and configured to provide a forward elastic force to the first rotating shaft and a second elastic element disposed in the second guide hole and configured to provide a forward elastic force to the second rotating shaft. In this example, the refrigerator may include a first interlocking member disposed in the first guide hole and configured to be moved in the forward and rearward direction and a second interlocking member disposed in the second guide hole and configured to be moved in the forward and rearward direction.

The first rotating bar may include a first front rotating bar and a first rear rotating bar and the second rotating bar may include a second front rotating bar and a second rear rotating bar. The shelf may be rotatably supported at a front area of the shelf by the first front rotating bar and the second front rotating bar and the shelf may be rotatably supported at a rear area of the shelf by the first rear rotating bar and the second rear rotating bar. The first interlocking member may be connected to the first front rotating bar and the first rear rotating bar, and the second interlocking member may be connected to the second front rotating bar and the second rear rotating bar.

In addition, the first elastic element may be configured to provide forward elastic force to the first interlocking member and the second elastic element may be configured to provide forward elastic force to the second interlocking member. The refrigerator also may include a first connecting bar connected between the first rotating bar and the second rotating bar.

In some implementations, the refrigerator may include a first stopper configured to hold the first rotating bar based on the shelf having been rotated to an upward position, the first stopper being configured to restrict rotation of the first rotating bar in a manner that holds the shelf in the upward position. In these implementations, the first stopper may include a passage portion that is open at a first side of the first stopper and that allows the first rotating bar to pass through the passage portion, a seating portion that seats the first rotating bar after the first rotating bar has passed through the passage portion, and a resisting portion that protrudes from the passage portion and that restricts rotating movement of the first rotating bar. Also, in these implementations, the first stopper may be made of an elastic material such that the first rotating bar is held in the seating portion through elastic force provided by the resisting portion.

In some examples, the refrigerator may include a second stopper configured to hold the shelf based on the shelf having been rotated to an upward position. In these examples, the second stopper may include a fitting portion provided on an inner wall of the storage compartment and a stopper protrusion that protrudes from the shelf and that is configured to engage with the fitting portion.

In some implementations, the refrigerator may include a first damper disposed in the first guide hole and configured to dampen forward and rearward movement of the first rotating shaft of the first rotating bar based on the first rotating shaft of the first rotating bar sliding in the first guide hole in the forward and rearward direction and a second damper disposed in the second guide hole and configured to dampen forward and rearward movement of the second rotating shaft of the second rotating bar based on the second rotating shaft of the second rotating bar sliding in the second guide hole in the forward and rearward direction. In these implementations, the refrigerator may include a rear protrusion that protrudes from a rear region of the shelf and that is configured to restrict a stored object from falling over due to forward and rearward movement of the shelf. Also, in these implementations, the refrigerator may include a first guide unit configured to attach to the first inner wall of the storage compartment and that has the first guide hole defined in the first guide unit and a second guide unit configured to attach to the second inner wall of the storage compartment and that has the second guide hole defined in the second guide unit.

Further, the shelf may include a central plate configured to receive an object for storage on the shelf and a frame surrounding the central plate. The first guide unit may include a first guide unit rail surface configured to guide sliding of the shelf in forward and rearward directions and the second guide unit may include a second guide unit rail surface configured to guide sliding of the shelf in forward and rearward directions.

Both the foregoing general description and the following detailed description are exemplary and explanatory and are intended to provide further explanation of the subject matter claimed.

BRIEF DESCRIPTION OF THE DRAWINGS

FIG. 4(*a*) is a cross-sectional view showing an example in which an interlocking member is located at a front end position;

FIG. 4(*b*) is a cross-sectional view showing an example in which an interlocking member is located at a rear end position;

DETAILED DESCRIPTION

Reference will now be made in detail to examples illustrated in the accompanying drawings. The examples of construction of an apparatus, which will hereinafter be described, and a method of controlling the apparatus are given only for illustrative purposes and the disclosure is not limited thereto. Use of the same reference numbers refer to the same or like parts.

For reference, directions to which the description refers are defined as follows. Based on a user viewing the refrigerator shown in FIG. 1, the left and right directions are defined as leftward and rightward, respectively, and the upper and lower directions are defined as upward and downward, respectively. In addition, the direction toward the interior of a storage compartment 200 (the direction away from the user) is defined as rearward, and the direction toward the front of the storage compartment 200 (the direction toward the user) is defined as forward.

Figure 1:
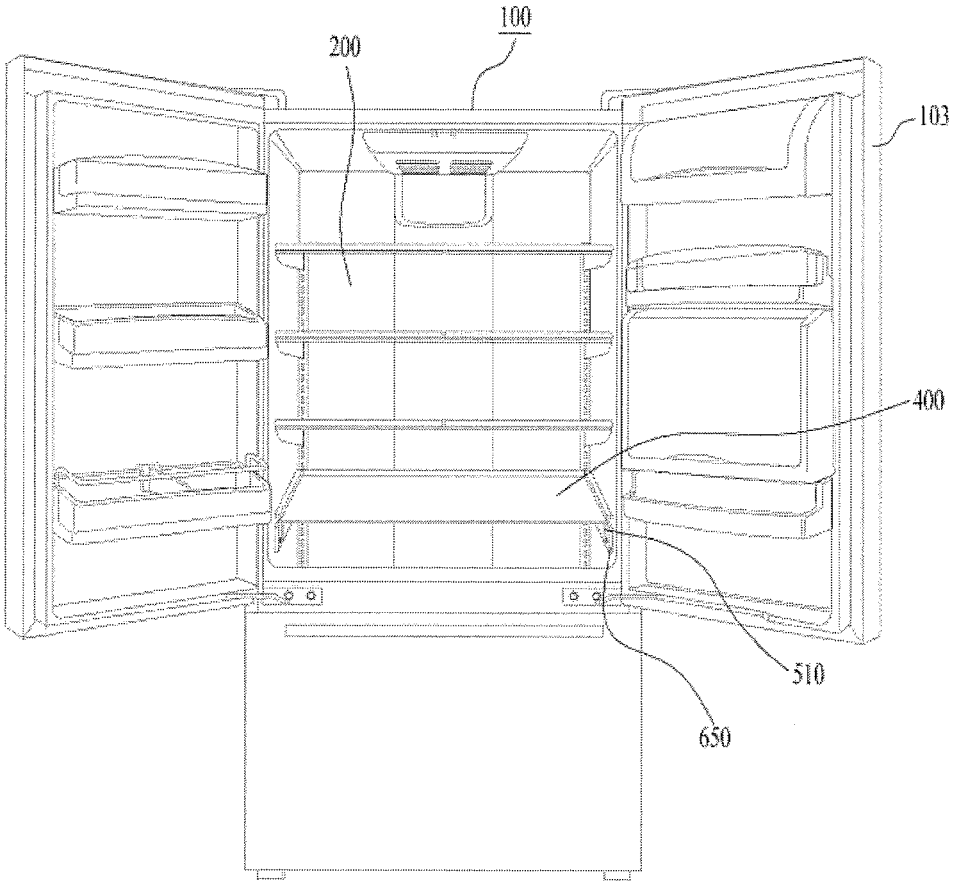
FIG. 1 is a front perspective view of an example refrigerator.

An example shelf 400 included in an example refrigerator will be described with reference to FIG. 1.

The refrigerator includes a cabinet 100 defining the appearance of the refrigerator, a storage compartment 200 defined in the cabinet 100 to store objects, and a shelf 400, which is disposed in the storage compartment 200 and on which the stored objects are placed.

The storage compartment 200 serves as a space for retaining cold air supplied thereto, and includes a freezing compartment for maintaining the temperature of the internal air below the freezing point and a refrigerating compartment for maintaining the temperature of the internal air above the freezing point, but at a refrigerated temperature below room temperature.

The cabinet 100 is provided at one side thereof with a door 103 for opening and closing the storage compartment 200.

The shelf 400 is constructed to be movable forward, rearward, upward and downward in the storage compartment 200. A user can slide the shelf 400 forward in order to remove a stored object located at a rear position, and can move the shelf 400 upward in order to adjust the height of the shelf 400.

Figure 2:
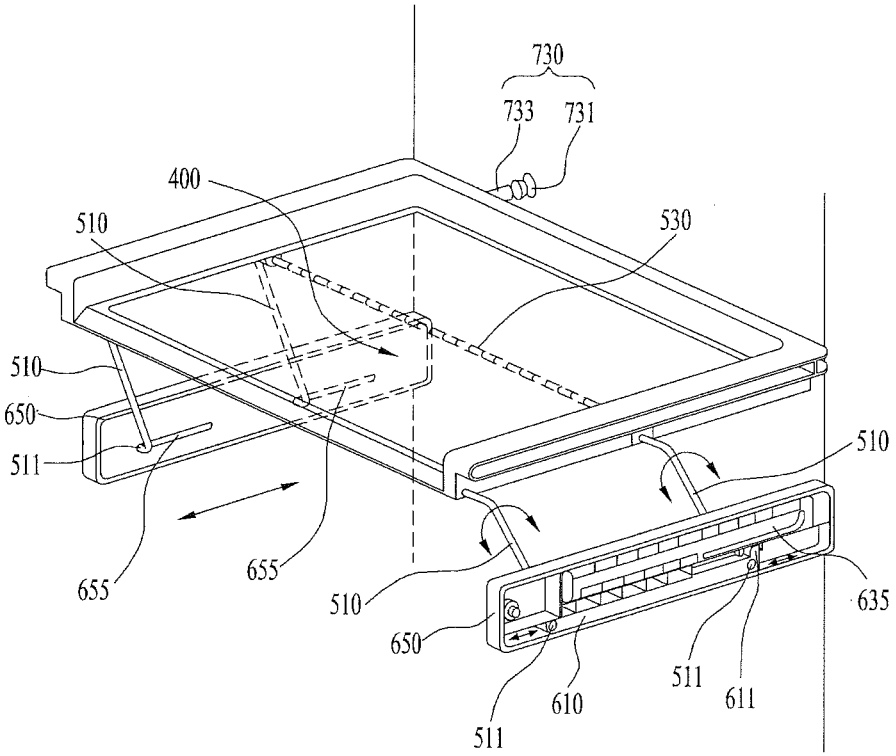
FIG. 2 is a perspective view of an example shelf and example components.

The structure capable of moving the shelf 400 upward, downward, forward and rearward is now described with reference to FIG. 2.

The refrigerator may include guide units 650, attached to inner walls of the storage compartment 200, guide holes 655 formed in the guide units 650, rotating bars 510 that are rotatably fitted in the guide holes 655, and the shelf 400, which is rotatably coupled to the rotating bars 510.

In some implementations, the guide holes 655 may be formed in the inner walls of the storage compartment 200 without providing the guide units 650, and the rotating bars 510 may be rotatably fitted in the guide holes 655 in the inner walls of the storage compartment 200.

Accordingly, in order to adjust the height of the shelf 400, a user may grasp the front portion of the shelf 400 and may move the shelf 400 upward or downward by raising or lowering the shelf 400.

The rotating shafts of the rotating bars 510 fitted in the guide holes 655 are referred to as first rotating shafts 511. The first rotating shafts 511 are constructed to be movable frontward or rearward. To this end, each of the guide holes 655 has a space extending rearward and forward so as to allow each of the first rotating shafts 511 to be moved rearward and forward.

Hereinafter, the structure for maintaining the balance of the shelf 400 in the forward and rearward direction and the balance of the shelf 400 in the leftward and rightward direction will now be described.

In order for a user to keep the shelf 400 in balance in the forward and rearward direction, each of the guide units 650 is provided with two rotating bars 510 at front and rear positions. Each of the guide units 650 may include an interlocking member 610 for interlocking the front rotating bar 510 with the rear rotating bar 510.

The interlocking member 610 is disposed in the space defined in the guide hole 655 so as to be moved forward and rearward.

The interlocking member 610 rotatably supports the front and rear rotating bars 510 at both ends thereof. For instance, the first rotating shafts 511 of the front and rear rotating bars 510 are supported by the interlocking member 610. Consequently, the interlocking member 610 serves to prevent the balance of the shelf 400 from being lost in the forward or rearward direction due to independent movements of the front and rear first rotating shafts 511.

Furthermore, since the interlocking member 610 may be moved in the forward and rearward direction, it is possible for a user to move the shelf 400 vertically upward. This is because the first rotating shafts 511 may be moved forward and rearward when the shelf 400 is moved vertically.

Accordingly, the turning radius of the shelf 400 may be minimized in the forward and rearward direction and thereby prevent stored objects from falling over due to rotation of the shelf 400.

Furthermore, in order to maintain the balance of the shelf 400 in the rightward and leftward direction while the shelf 400 is raised by a user, the rotating bars 510 may be provided at both right and left sides of the shelf 400, and connecting bars 530 that are connected to both the right and left rotating bars 510 may be provided.

The connecting bars 530 may be provided at both front and rear rotating bars 510, or may be provided only at one of the front and rear rotating bars 510.

Hereinafter, the structure provided at the shelf 400 to prevent the turnover of stored objects due to the movement of the shelf 400 will now be described.

Figure 3:
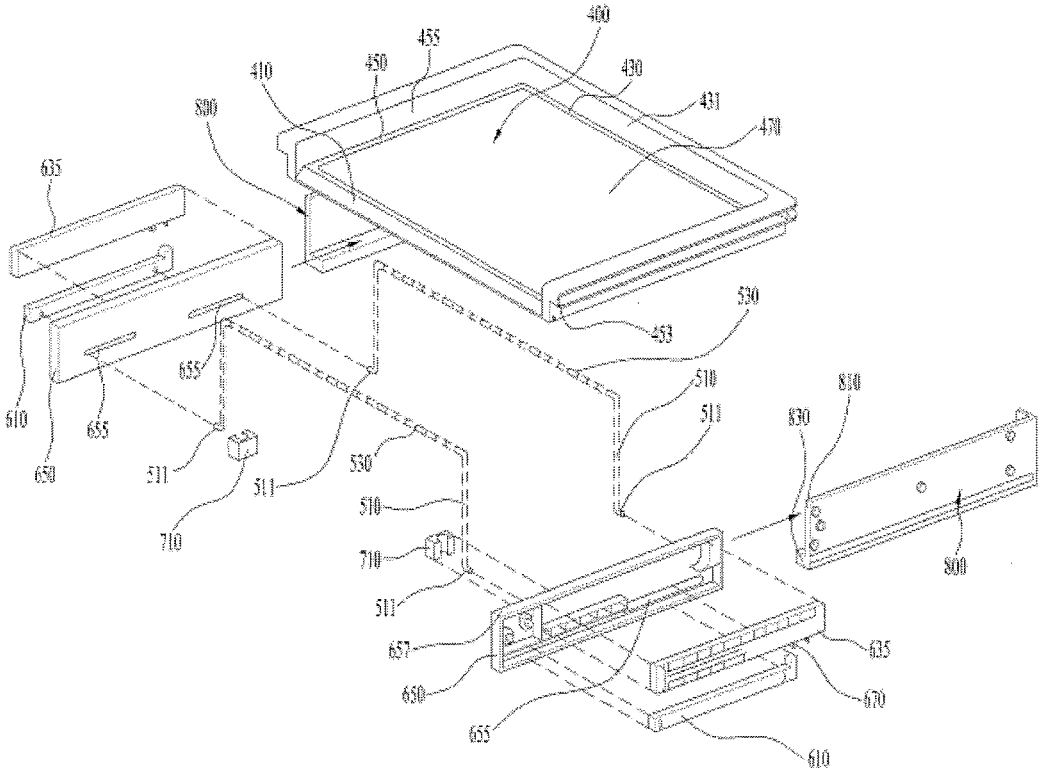
FIG. 3 is an exploded perspective view of the example shelf and components shown in FIG. 2.

FIG. 3 illustrates an example structure for allowing the shelf 400 of the refrigerator to be moved upward, downward, forward, and rearward.

Referring to FIG. 3, the shelf 400 includes a central plate 470 on which stored objects are placed and frames 410, 430, and 450 surrounding the central plate 470.

The central plate 470 is made of a transparent material, such as a glass material so as to enable stored objects placed on an adjacent upper or lower shelf 400 to be seen.

The frames includes a front frame 410 coupled to the front side of the central plate 470, a rear frame 430 coupled to the rear side of the central plate 470, and side frames 450 connected between the front frame 410 and the rear frame 430.

The front frame 410 may include a lower protrusion protruding downward therefrom, which serves to prevent the connecting bar 530 from being seen by a user.

Furthermore, the rear frame 430 may include a rear protrusion 431 protruding upward, which serves to prevent stored objects from falling over during movement of the shelf 400.

The side frames 450 also may include side protrusions 455 protruding upward, which serve to prevent stored objects from falling down during movement of the shelf 400.

Hereinafter, the structure for guiding the shelf 400 during the sliding of the shelf 400 will be described.

Figure 7:
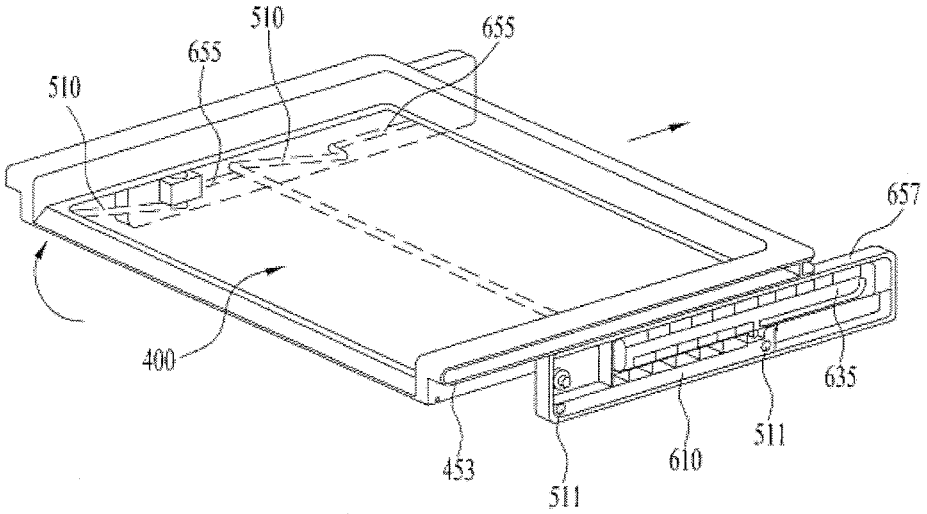
FIG. 7 is a perspective view of an example shelf slid to a front end position.
Figure 8:
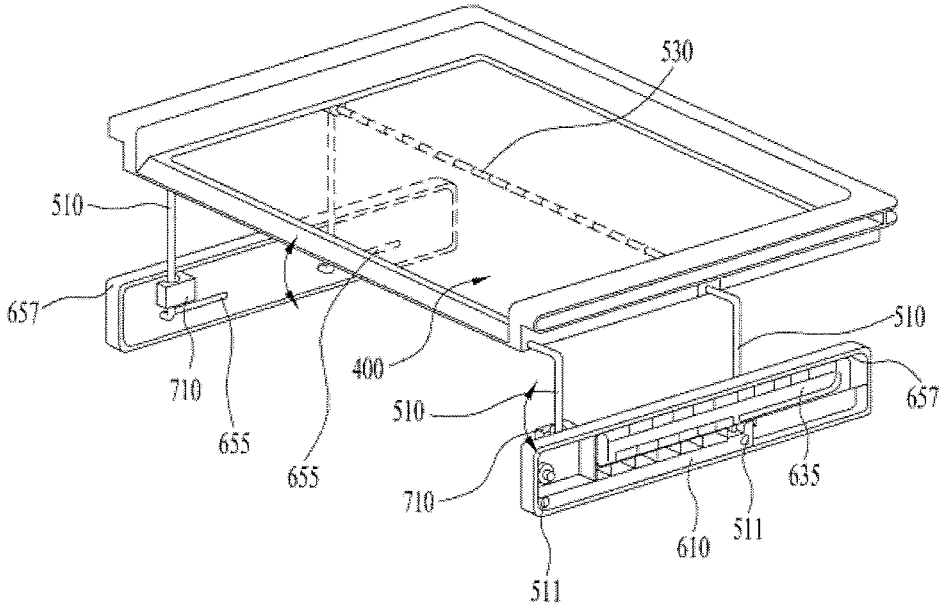
FIG. 8 is a perspective view of an example shelf moved upward and held at an upward position.

The shelf 400 may be constructed to be guided and slid forward and rearward by guide unit rail surfaces 657 provided at the upper surfaces of the guide units 650 (see FIG. 7).

More specifically, shelf slide surfaces 453 provided at the lower surfaces of the side frames 450 are guided by the guide unit rail surfaces 657.

The guide unit rail surfaces 657 serve to support the load of the shelf 400 so as to prevent the shelf 400 from falling down, and to restrict a height range of the shelf 400.

Hereinafter, a structure capable of securing the guide units 650 to the storage compartment using separate members without directly attaching the guide units 650 to the inner wall of the storage compartment 200 will be described.

In some examples, guide unit supports 800 are installed on the inner wall of the storage compartment 200.

Accordingly, it is possible for a user to couple the shelf 400, the rotating bars 510, the guide units 650, and the like, which have been preassembled, to the guide unit supports 800.

Each of the guide unit supports 800 includes a support attachment 810 attached to the inner wall of the storage compartment 200 and a support rail surface 830 protruding perpendicularly from a lower end of the support attachment 810.

Accordingly, a user can easily install the shelf 400 in the storage compartment 200 by fitting the guide units 650 along the support rail surfaces 830.

Hereinafter, a structure capable of smoothly moving the shelf 400 during forward and rearward movement of the shelf 400 will now be described.

FIGS. 4(*a*) and 4(*b*) are cross-sectional views showing an example actuating unit 635 including an elastic element 630 and a damper 640. The interlocking member 610 is actuated by the actuating unit 635.

Referring to FIGS. 4(*a*) and 4(*b*), example functions of providing a propulsive force when the shelf 400 is moved forward and serving as a damper when the shelf 400 is moved rearward by the elastic element 630 will now be described.

The elastic element 630 may be provided in the guide unit 650. For instance, the elastic element 630 may be provided in the actuating unit 635 disposed in the guide unit 650.

In some examples, a refrigerator may include the elastic element 630 accommodated in the guide hole 655. In these examples, the guide hole 655 may be formed in the inner wall of the storage compartment 200. Further, in these examples, the guide hole 655 may include not only a space in which the interlocking member 610 moves, but also a space for accommodating the elastic element 630.

The elastic element 630 may be a spring. Although the restoring force of a compressed spring may be employed, the restoring force of a tensioned spring also may be used.

A first end of the elastic element 630 may be secured to a front side in the guide unit 650 or the actuating unit 635, and a second end of the elastic element 630 may be directly connected to the first rotating shaft 511 or the interlocking member 610 to which the first rotating shaft 511 is connected.

In some implementations, the elastic element 630 may be connected to a connecting member 670, which is connected to both the damper 640 and the interlocking member 610 and will be described in more detail below.

The connecting member 670 may include an intermediate portion 671, into which an interlocking member protrusion 611 is fitted, so as to transmit the elastic force.

Accordingly, when the shelf 400 moves forward, the elastic force provides the shelf 400 with a forward propulsive force, whereby a user can move the shelf 400 forward without having to put much effort into the forward movement. Also, when the shelf 400 moves rearward, the elastic force serves as a resisting force against the rearward movement of the shelf 400, thereby dampening rearward movement of the shelf 400.

The elastic force of the elastic element 630 serves as a force that resists the rearward movement of the interlocking member 610 or the first rotating shafts 511. Therefore, when a user rotates the shelf 400 about the first rotating shafts 511 in order to raise the shelf 400, it is possible to prevent the first rotating shafts 511 from being pushed rearward.

Furthermore, the elastic force of the elastic element 630 prevents the first rotating shafts 511 from being moved after the shelf 400 has been raised and held, thus preventing the shelf 400 from falling down.

Hereinafter, damping the speed of the shelf 400 by the damper 640 during forward or rearward movement will be described.

The damper 640 may be provided in the guide unit 650. For example, the damper 640 may be provided in the actuating unit 635 housed in the guide unit 650.

In some implementations, a refrigerator may include a damper 640 disposed in the guide hole 655. In these implementations, the guide hole 655 may be formed in the inner wall of the storage compartment 200. Further, in these implementations, the guide hole 655 may include not only a space in which the interlocking member 610 moves, but also a space for accommodating the damper 640.

In some examples, a first end of the damper 640 may be secured to an internal front portion of the guide unit 650 or the actuating unit 635, and a second end of the damper 640 may be directly connected to the first rotating shaft 511 or the interlocking member 610 to which the first rotating shaft 511 is connected.

However, the damper 640 also may be connected to the connecting member 670.

Accordingly, when the shelf 400 moves forward or rearward, the moving speed of the shelf 400 is decreased, thereby preventing stored objects from falling over or the shelf 400 from breaking due to fast movement of the shelf 400.

When the shelf 400 moves forward, the shelf 400 acquires the propulsive force resulting from the elastic force of the elastic element 630 and then the forward moving speed of the shelf 400 is gradually decreased by the damper 640. When the shelf 400 moves rearward, the rearward moving speed of the shelf 400 is restricted by the elastic element 630 and the damper 640.

Consequently, when a user moves the shelf 400 forward or rearward, the shelf 400 smoothly moves forward or rearward, and stored objects placed on the shelf 400 do not fall over.

In order to prevent the shelf 400 from moving after the shelf 400 has moved rearward, the shelf 400 may be provided at the rear side thereof with a second stopper 730, which will be described in more detail below. In some implementations, the connecting member 670 moves forward and rearward together with the interlocking member 610.

The connecting member 670 may include a connecting member guide 673 disposed in the actuating unit 635 so as to guide forward and rearward movement of the connecting member 670 and a holding slope portion 675 formed at the end of the connecting member guide 673 so as to hold the connecting member 670.

Accordingly, when the shelf 400 moves completely rearward, the connecting member 670 is caught by the holding slope portion 675. Thereafter, when the shelf 400 is pulled forward by a user, the engagement between the connecting member 670 and the holding slope portion 675 is released, and thus the propulsive force is applied to the shelf 400 by virtue of the elastic element 630.

The guide unit 650 may have any external shape as long as it accommodates the interlocking member 610 and the elastic element 630 therein. Since the guide unit 650 is provided on the inner wall of the storage compartment, the guide unit 650 may have horizontal and vertical dimensions that are as short as possible in order to reduce the area that can be seen by a user and to ensure optimal utilization of the space in the storage compartment 200.

Hereinafter, a stopper for holding the shelf 400 after the shelf 400 has been raised will be described.

Referring again to FIG. 2, the stopper may include the second stopper 730 for holding the shelf 400.

The second stopper 730 may include a second stopper protrusion 733 protruding from the shelf 400 and a fitting portion 731 provided on the inner wall of the storage compartment 200 so as to be fitted with the second stopper protrusion 733.

Alternatively, the second stopper protrusion 733 may be provided on the inner wall of the storage compartment 200 and the fitting portion 731 may be provided at the shelf 400.

The second stopper protrusion 733 is fitted into the fitting portion 731.

Specifically, the second stopper protrusion 733 and the fitting portion 731 are made of an elastic material such that the engagement or release between the second stopper protrusion 733 and the fitting portion 731 occurs only when a force having a predetermined value or higher is applied thereto.

Figure 5:
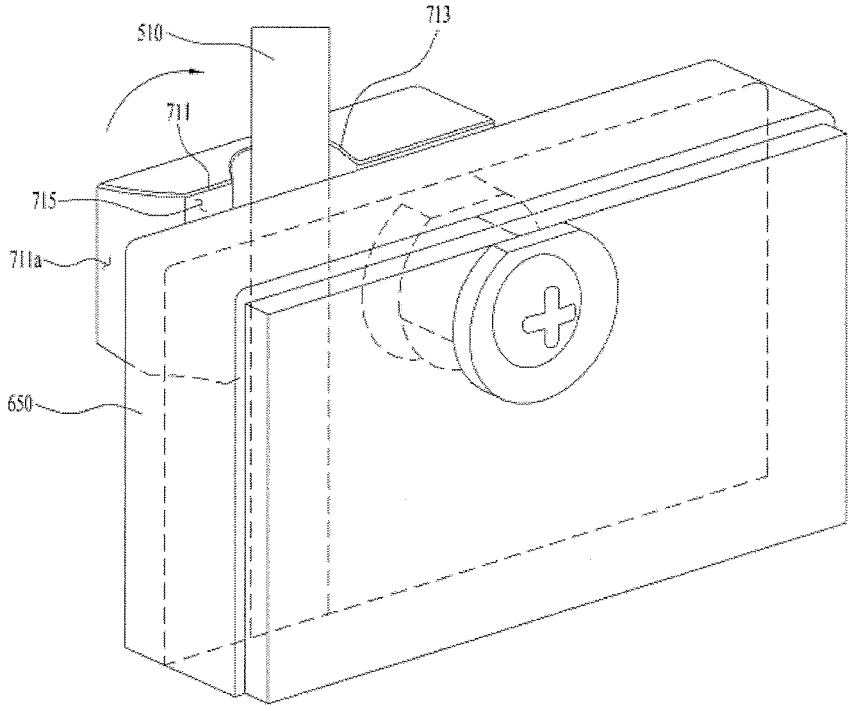
FIG. 5 is an assembled perspective view of an example first stopper.
Figure 6:
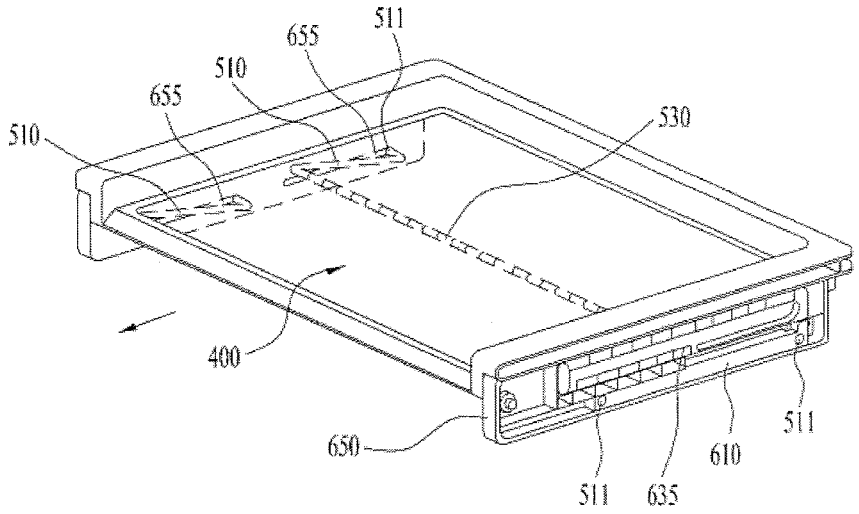
FIG. 6 is a perspective view of an example shelf held at a rear end position.

As shown in FIGS. 3 and 5, the refrigerator may additionally or alternatively include a first stopper 710 for holding the rotating bar 510.

The first stopper 710 may be secured at one side thereof to the guide unit 650 or the inner wall of the storage compartment 200 by a fastening element.

The first stopper may include a passage portion 715 through which the rotating bar 510 is inserted into the first stopper 710, a seating portion 713, in which the rotating bar 510 having passed through the passage portion 715, is seated, and a resisting portion 711 protruding from the passage portion 715 to resist the rotation of the rotating bar 510.

The resisting portion 711 is positioned within the range of the turning radius of the rotating bar 510 so as to resist the movement of the rotating bar 510 entering the passage portion 715.

The resisting portion 711 includes an inclined surface 711*a* that faces the rotating bar 510 such that the rotating bar 510 can smoothly enter the passage portion 715 through the inclined surface 711*a*.

The first stopper 710 is made of an elastic material. Therefore, when the rotating bar 510 passes through the resisting portion 711, the passage portion 715 flexes outward, and thus the space between the passage portion 715 and the guide unit 650 is enlarged so as to allow the rotating bar 510 to pass therethrough.

The first stopper 710 is configured such that the rotating bar 510 seated in the seating portion 713 remains at a position which is inclined rearward at a predetermined angle from the vertical position. Consequently, it is possible to restrict the rotating bar 510 from escaping from the first stopper 710 due to the application of a load to the shelf 400 or an external impact.

Hereinafter, example functions of moving the shelf 400 vertically in the forward and rearward direction and holding the shelf 400 will be described in more detail.

The forward and rearward movement of the shelf 400 is described with reference to FIGS. 4(*b*) and 6. Referring to FIGS. 4(*b*) and 6, the shelf 400 is held at the rear end of the storage compartment 200. When a user pulls the shelf 400 to move the shelf 400 forward, the connecting member 670 is released from the engagement with the holding slope portion 675. Subsequently, the interlocking member 610 is pulled forward by the elastic element 630, and the shelf 400 is also moved forward by the elastic force.

When the shelf 400 reaches the forward end point, the moving speed of the shelf 400 is decreased and the shelf 400 is smoothly stopped.

As a result, the shelf 400 is positioned at the forward end point, as shown in FIG. 7.

When a user pushes the shelf 400 to move the shelf 400 to the rear position of the storage compartment 200, the moving speed of the shelf 400 is increased as the shelf 400 is moved rearward. At this point, the moving speed of the shelf 400 cannot be increased above a predetermined speed by the restoring force generated during the stretching of the elastic element 400 and the damping action of the damper 640. When the shelf 400 reaches the rear end point, the moving speed of the shelf 400 is decreased, and the shelf 400 is smoothly stopped.

The vertical movement of the shelf 400 is described with reference to FIGS. 4(*a*) and 8. When a user raises the shelf 400 to adjust the height of the shelf 400, the rotating bars 510 are rotated about the first rotating shafts 511 and moved upward because the first rotating shafts 511 are biased forward by the elastic force of the elastic element 630.

After upward movement, the rotating bars 510 are held by the first stopper 710, and are thus maintained at the upper position.

In order to lower the shelf 400, a user first grasps the front portion of the shelf 400 and applies a forward force to the shelf 400 so as to release the held state whereby the rotating shafts 510 are held by the first stoppers 710. Subsequently, a user applies a downward force to the shelf 400 until the shelf 400 is supported by the guide unit rail surfaces 657.

As described above, a refrigerator may be equipped with a shelf that is constructed to be adjusted in height even when stored objects are placed on the shelf.

Furthermore, a refrigerator may be equipped with a shelf capable of being slid forward so as to enable a user to easily take out stored objects when the stored objects are located at a deep position on the shelf.

In addition, a refrigerator may be equipped with a shelf capable of minimizing the turning radius of the shelf measured in the forward and rearward direction when a user raises the shelf.

It will be apparent to those skilled in the art that various modifications and variations can be made without departing from the spirit or scope of the disclosure. Thus, the present disclosure covers modifications and variations provided they come within the scope of the appended claims and their equivalents.

What is claimed is:

1. A refrigerator comprising:

a cabinet that defines an appearance of the refrigerator;

a storage compartment defined in the cabinet and configured to store an object;

a first guide hole located at a first inner wall of the storage compartment;

a second guide hole located at a second inner wall of the storage compartment, the second inner wall of the storage compartment being opposite of the first inner wall of the storage compartment;

a first rotating bar that includes a first rotating shaft fitted in the first guide hole, the first rotating bar being configured to rotate about the first rotating shaft;

a second rotating bar that includes a second rotating shaft fitted in the second guide hole, the second rotating bar being configured to rotate about the second rotating shaft; and a shelf configured to support an object stored in the storage compartment, the shelf being rotatably supported by the first rotating bar and the second rotating bar and being adjustable in height based on rotation of the first rotating bar and the second rotating bar, a first elastic element disposed in the first guide hole and configured to provide a forward elastic force to the first rotating shaft; and a second elastic element disposed in the second guide hole and configured to provide a forward elastic force to the second rotating shaft, a first damper disposed in the first guide hole and configured to dampen forward and rearward movement of the first rotating shaft of the first rotating bar based on the first rotating shaft of the first rotating bar sliding in the first guide hole in the forward and rearward direction; and a second damper disposed in the second guide hole and configured to dampen forward and rearward movement of the second rotating shaft of the second rotating bar based on the second rotating shaft of the second rotating bar sliding in the second guide hole in the forward and rearward direction wherein the first guide hole has a first space that extends in a forward and rearward direction and that allows the first rotating shaft of the first rotating bar to slide in the first guide hole in the forward and rearward direction, wherein the second guide hole has a second space that extends in the forward and rearward direction and that allows the second rotating shaft of the second rotating bar to slide in the second guide hole in the forward and rearward direction, wherein the shelf is configured to slide in the forward and rearward direction based on the first rotating shaft of the first rotating bar sliding in the first guide hole with the second rotating shaft of the second rotating bar sliding in the second guide hole, and wherein, based on the shelf being rotated to an upward position, the first rotating shaft is biased forward by the forward elastic force of the first elastic element and the second rotating shaft is biased forward by the forward elastic force of the second elastic element.

2. The refrigerator according to claim 1, further comprising:

a first interlocking member disposed in the first guide hole and configured to be moved in the forward and rearward direction; and a second interlocking member disposed in the second guide hole and configured to be moved in the forward and rearward direction, wherein the first rotating bar comprises a first front rotating bar and a first rear rotating bar, wherein the second rotating bar comprises a second front rotating bar and a second rear rotating bar, wherein the shelf is rotatably supported at a front area of the shelf by the first front rotating bar and the second front rotating bar, wherein the shelf is rotatably supported at a rear area of the shelf by the first rear rotating bar and the second rear rotating bar, wherein the first interlocking member is connected to the first front rotating bar and the first rear rotating bar, and wherein the second interlocking member is connected to the second front rotating bar and the second rear rotating bar.

3. The refrigerator according to claim 2, wherein the first elastic element is configured to provide forward elastic force to the first interlocking member and the second elastic element is configured to provide forward elastic force to the second interlocking member.

4. The refrigerator according to claim 1, further comprising a first connecting bar connected between the first rotating bar and the second rotating bar.

5. The refrigerator according to claim 1, further comprising a first stopper configured to hold the first rotating bar based on the shelf having been rotated to an upward position, the first stopper being configured to restrict rotation of the first rotating bar in a manner that holds the shelf in the upward position.

6. The refrigerator according to claim 5, wherein the first stopper comprises:

a passage portion that is open at a first side of the first stopper and that allows the first rotating bar to pass through the passage portion;

a seating portion that seats the first rotating bar after the first rotating bar has passed through the passage portion; and a resisting portion that protrudes from the passage portion and that restricts rotating movement of the first rotating bar.

7. The refrigerator according to claim 6, wherein the first stopper is made of an elastic material such that the first rotating bar is held in the seating portion through elastic force provided by the resisting portion.

8. The refrigerator according to claim 7, further comprising:

a first damper disposed in the first guide hole and configured to dampen forward and rearward movement of the first rotating shaft of the first rotating bar based on the first rotating shaft of the first rotating bar sliding in the first guide hole in the forward and rearward direction; and a second damper disposed in the second guide hole and configured to dampen forward and rearward movement of the second rotating shaft of the second rotating bar based on the second rotating shaft of the second rotating bar sliding in the second guide hole in the forward and rearward direction.

9. The refrigerator according to claim 6, further comprising:

a first damper disposed in the first guide hole and configured to dampen forward and rearward movement of the first rotating shaft of the first rotating bar based on the first rotating shaft of the first rotating bar sliding in the first guide hole in the forward and rearward direction; and a second damper disposed in the second guide hole and configured to dampen forward and rearward movement of the second rotating shaft of the second rotating bar based on the second rotating shaft of the second rotating bar sliding in the second guide hole in the forward and rearward direction.

10. The refrigerator according to claim 5, further comprising a rear protrusion that protrudes from a rear region of the shelf and that is configured to restrict a stored object from falling over due to forward and rearward movement of the shelf.

11. The refrigerator according to claim 5, further comprising:

a first guide unit configured to attach to the first inner wall of the storage compartment and that has the first guide hole defined in the first guide unit; and a second guide unit configured to attach to the second inner wall of the storage compartment and that has the second guide hole defined in the second guide unit.

12. The refrigerator according to claim 11, wherein the shelf comprises:

a central plate configured to receive an object for storage on the shelf; and a frame surrounding the central plate, wherein the first guide unit comprises a first guide unit rail surface configured to guide sliding of the shelf in forward and rearward directions, and wherein the second guide unit comprises a second guide unit rail surface configured to guide sliding of the shelf in forward and rearward directions.

13. The refrigerator according to claim 1, further comprising a second stopper configured to hold the shelf based on the shelf having been rotated to an upward position.

14. The refrigerator according to claim 13, wherein the second stopper comprises:

a fitting portion provided on an inner wall of the storage compartment; and a stopper protrusion that protrudes from the shelf and that is configured to engage with the fitting portion.

15. The refrigerator according to claim 14, further comprising:

a first damper disposed in the first guide hole and configured to dampen forward and rearward movement of the first rotating shaft of the first rotating bar based on the first rotating shaft of the first rotating bar sliding in the first guide hole in the forward and rearward direction; and a second damper disposed in the second guide hole and configured to dampen forward and rearward movement of the second rotating shaft of the second rotating bar based on the second rotating shaft of the second rotating bar sliding in the second guide hole in the forward and rearward direction.

16. The refrigerator according to claim 13, further comprising:

a first damper disposed in the first guide hole and configured to dampen forward and rearward movement of the first rotating shaft of the first rotating bar based on the first rotating shaft of the first rotating bar sliding in the first guide hole in the forward and rearward direction; and a second damper disposed in the second guide hole and configured to dampen forward and rearward movement of the second rotating shaft of the second rotating bar based on the second rotating shaft of the second rotating bar sliding in the second guide hole in the forward and rearward direction.

17. The refrigerator according to claim 1:

wherein the first guide hole is located in the first inner wall of the storage compartment, and wherein the second guide hole is located in the second inner wall of the storage compartment.

18. The refrigerator according to claim 1, further comprising:

a first stopper configured to hold the first rotating bar based on the shelf having been rotated to an upward position, the first stopper being configured to restrict rotation of the first rotating bar in a manner that holds the shelf in the upward position; and a second stopper configured to hold the shelf based on the shelf having been rotated to the upward position, wherein the first stopper comprises:

a passage portion that is open at a first side of the first stopper and that allows the first rotating bar to pass through the passage portion;

a seating portion that seats the first rotating bar after the first rotating bar has passed through the passage portion; and a resisting portion that protrudes from the passage portion and that restricts rotating movement of the first rotating bar, wherein the first stopper is made of an elastic material such that the first rotating bar is held in the seating portion through elastic force provided by the resisting portion, and wherein the second stopper comprises:

a fitting portion provided on an inner wall of the storage compartment; and a stopper protrusion that protrudes from the shelf and that is configured to engage with the fitting portion.

19. A refrigerator comprising:

a cabinet that defines an appearance of the refrigerator;

a storage compartment defined in the cabinet and configured to store an object;

a first guide hole located at a first inner wall of the storage compartment;

a second guide hole located at a second inner wall of the storage compartment, the second inner wall of the storage compartment being opposite of the first inner wall of the storage compartment;

a first rotating bar that includes a first rotating shaft fitted in the first guide hole, the first rotating bar being configured to rotate about the first rotating shaft;

a second rotating bar that includes a second rotating shaft fitted in the second guide hole, the second rotating bar being configured to rotate about the second rotating shaft; and a shelf configured to support an object stored in the storage compartment, the shelf being rotatably supported by the first rotating bar and the second rotating bar and being adjustable in height based on rotation of the first rotating bar and the second rotating bar, a first elastic element disposed in the first guide hole and configured to provide a forward elastic force to the first rotating shaft; and a second elastic element disposed in the second guide hole and configured to provide a forward elastic force to the second rotating shaft, wherein the first guide hole has a first space that extends in a forward and rearward direction and that allows the first rotating shaft of the first rotating bar to slide in the first guide hole in the forward and rearward direction, wherein the second guide hole has a second space that extends in the forward and rearward direction and that allows the second rotating shaft of the second rotating bar to slide in the second guide hole in the forward and rearward direction, wherein the shelf is configured to slide in the forward and rearward direction based on the first rotating shaft of the first rotating bar sliding in the first guide hole with the second rotating shaft of the second rotating bar sliding in the second guide hole, and wherein, based on the shelf being rotated to an upward position, the first rotating shaft is biased forward by the forward elastic force of the first elastic element and the second rotating shaft is biased forward by the forward elastic force of the second elastic element.

20. A refrigerator comprising:

a cabinet that defines an appearance of the refrigerator;

a storage compartment defined in the cabinet and configured to store an object;

a first guide hole located at a first inner wall of the storage compartment;

a second guide hole located at a second inner wall of the storage compartment, the second inner wall of the storage compartment being opposite of the first inner wall of the storage compartment;

a first rotating bar that includes a first rotating shaft fitted in the first guide hole, the first rotating bar being configured to rotate about the first rotating shaft;

a second rotating bar that includes a second rotating shaft fitted in the second guide hole, the second rotating bar being configured to rotate about the second rotating shaft; and a shelf configured to support an object stored in the storage compartment, the shelf being rotatably supported by the first rotating bar and the second rotating bar and being adjustable in height based on rotation of the first rotating bar and the second rotating bar, a first stopper configured to hold the first rotating bar based on the shelf having been rotated to an upward position, the first stopper being configured to restrict rotation of the first rotating bar in a manner that holds the shelf in the upward position; and a second stopper configured to hold the shelf based on the shelf having been rotated to the upward position, wherein the first stopper comprises:

a passage portion that is open at a first side of the first stopper and that allows the first rotating bar to pass through the passage portion;

a seating portion that seats the first rotating bar after the first rotating bar has passed through the passage portion; and a resisting portion that protrudes from the passage portion and that restricts rotating movement of the first rotating bar, wherein the first guide hole has a first space that extends in a forward and rearward direction and that allows the first rotating shaft of the first rotating bar to slide in the first guide hole in the forward and rearward direction, wherein the second guide hole has a second space that extends in the forward and rearward direction and that allows the second rotating shaft of the second rotating bar to slide in the second guide hole in the forward and rearward direction, and wherein the shelf is configured to slide in the forward and rearward direction based on the first rotating shaft of the first rotating bar sliding in the first guide hole with the second rotating shaft of the second rotating bar sliding in the second guide hole, wherein the first stopper is made of an elastic material such that the first rotating bar is held in the seating portion through elastic force provided by the resisting portion, and wherein the second stopper comprises:

a fitting portion provided on an inner wall of the storage compartment; and a stopper protrusion that protrudes from the shelf and that is configured to engage with the fitting portion.

* * * * *